US005139293A

United States Patent [19]

Zimmerman et al.

[11] Patent Number: 5,139,293

[45] Date of Patent: Aug. 18, 1992

[54] ARMATURE ASSEMBLY FOR ELECTROMAGNETIC DOOR HOLDER

[75] Inventors: Michael Zimmerman; Mark A. New, both of Indianapolis, Ind.

[73] Assignee: Von Duprin, Inc., Indianapolis, Ind.

[21] Appl. No.: 789,564

[22] Filed: Nov. 8, 1991

[51] Int. Cl.[5] ..... E05C 19/16

[52] U.S. Cl. ..... 292/251.5; 292/DIG. 53; 292/DIG. 60

[58] Field of Search ..... 292/251.5, DIG. 60, 292/DIG. 53, DIG. 15

[56] References Cited

U.S. PATENT DOCUMENTS 3,261,631 7/1966 Alessi ..... 292/251.5
3,781,047 12/1973 Surko, Jr. ..... 292/251.5
4,335,911 6/1982 Taylor ..... 292/251.5 X
4,852,919 8/1989 Nimeé et al. ..... 292/251.5

*Primary Examiner*—Richard E. Moore
*Attorney, Agent, or Firm*—Robert F. Palermo

[57] ABSTRACT

An armature assembly for use with an electromagnetic door holder has a ball stud pivotably connected at one end to a mounting bracket and at the other end to an armature plate. The mounting bracket is mounted on a first structural member, a mounting body is secured to the bracket and connects with the ball stud, and the armature plate coacts with and is held against an electromagnet which is mounted on a second structural member. The pivotable attachments at both ends of the ball stud provide an almost universal adjustability to the armature assembly and, thus, accomodate complex misalignments between the first and second structural surfaces.

10 Claims, 3 Drawing Sheets

ARMATURE ASSEMBLY FOR ELECTROMAGNETIC DOOR HOLDER

BACKGROUND OF THE INVENTION

This invention relates generally to electromagnetic door holders and more particularly to armature assemblies for use with electromagnetic door holders.

Electromagnetic door holders are commonly used to hold fire doors open in hospitals, schools, hotels, and other buildings having corridors where fire doors are present and traffic is heavy. The electromagnet is normally wired into the fire alarm system or other emergency system for the building. When a fire is detected, the fire alarm or other emergency system will cause an interruption of power to the electromagnet. This will allow every electromagnetically held door to be released and to close, thereby containing the fire.

Since electromagnetic attractive force is proportional to contact area, it is clear that anything which reduces the area of contact between the electromagnet and the armature, will rapidly reduce the magnetic holding force. This can lead to unintended closing of fire doors which condition could create a hazard during emergency situations. Alignment and parallelism between the electromagnet and the armature plate are, therefore, important to the strength of the electromagnet-armature grip.

Misalignment and out of parallelism can be caused by structural sagging, improper matching of standoff distance between the door hinges and the electromagnet assembly, and defects in workmanship during mounting of the doors, the electromagnet, and the armature plates. Regardless of the cause, the weakening effect of non-parallel contact is the same, and attempts have been made to provide for adjustability to overcome the non-parallel condition. Most of these attempts have permitted adjustment of parallelism, but have failed to provide for alignment to assure complete face to face contact between the electromagnet and the armature.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an armature assembly, for use with an electromagnetic door holder, having a mounting body pivotably connected with a first end of a ball stud and mounted on a first structural member; and an armature plate for coacting with an electromagnet mounted on a second structural member, the armature plate being pivotably connected with a second end of the ball stud.

The foregoing and other aspects will become apparent from the following detailed description of the invention when considered in conjunction with the accompanying drawing figures.

DETAILED DESCRIPTION

Figure 1:
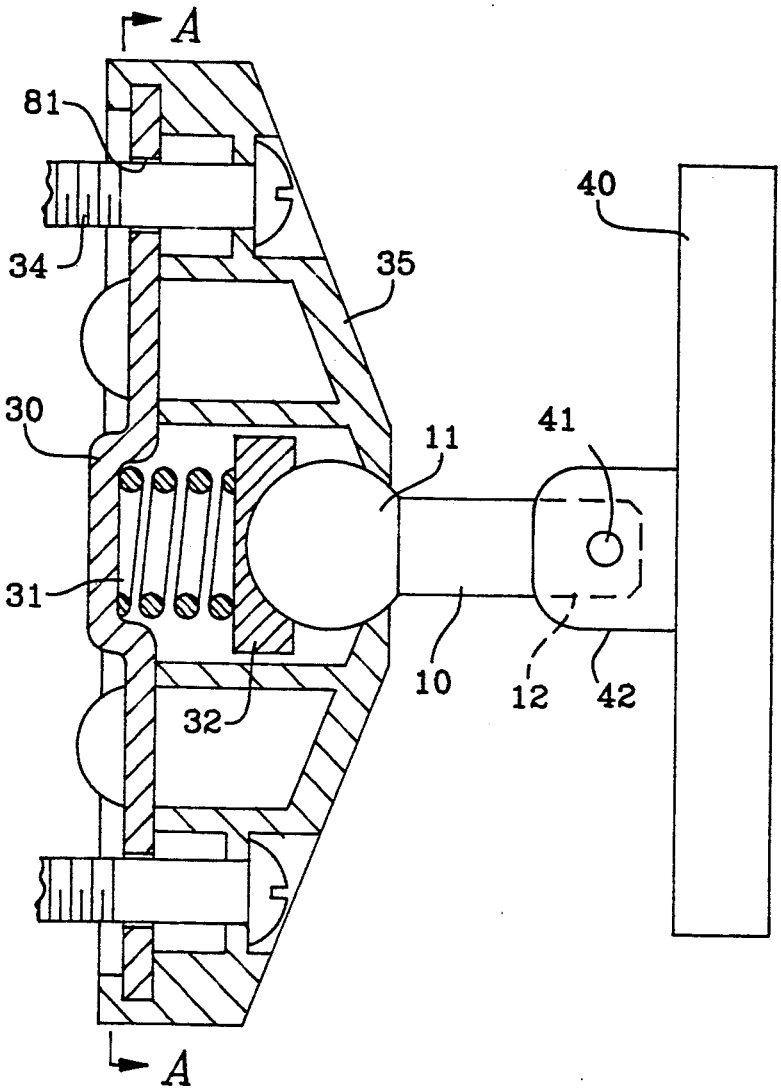
FIG. 1 shows the magnetic door holder armature assembly of the present invention in partial section to illustrate details of its construction.

The magnetic door holder armature assembly of the present invention is shown in FIG. 1. The armature mounting body 35 is preferably mounted to a door or movable structure using mounting bracket 30 which is secured by fasteners 34 through holes 81. Within mounting body 35 can be seen ball 11, socket cup 32, and spring 31 which is compressed between socket cup 32 and mounting bracket 30 to provide a biasing socket. Ball 11 is shown as one end of ball stud 10 which projects outwardly from body 35 and ends as a transversely drilled stud 12 at its other extremity. Armature plate 40 is articulably joined to ball stud 10 by means of pin 41 extending through transversely drilled stud 12 and clevis 42 which is permanently fixed to armature plate 40. Consideration of this figure shows that armature plate 40 is free to articulate about pin 41 by means of clevis 42. At the same time, ball stud 10 can be articulated in any direction and can also be rotated about its longitudinal axis. This combination of movement abilities permits the armature assembly to accommodate virtually any misalignment condition in any direction.

Figure 1A:
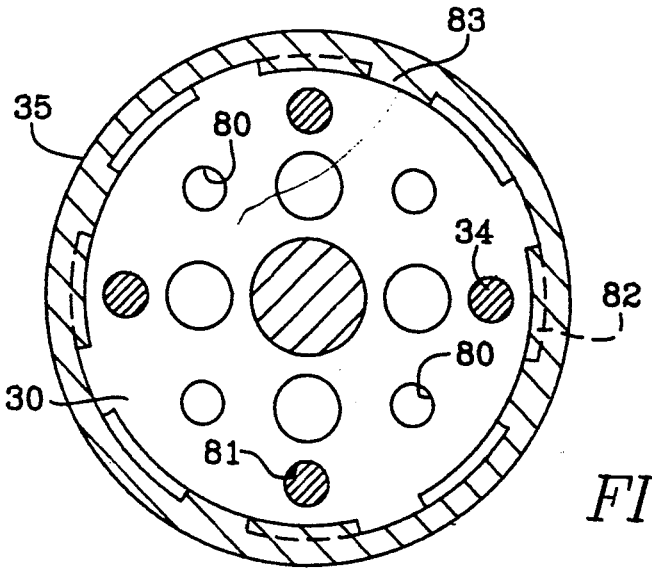
FIG. 1A is a view from line A—A of FIG. 1 illustrating the preferred arrangement for connecting the mounting body to the mounting bracket plate.

Figure 1A shows the preferred method of attaching mounting body 35 to mounting bracket plate 30. Mounting bracket plate 30 is fastened to a structural member using fasteners (not shown) in fastener holes 81. Mounting body 35 is then placed over mounting bracket plate 30 such that mounting body tabs 83 and mounting bracket tabs 82 are interdigitated. Body 35 is forced inward to compress spring 31 (FIG. 1) and is rotated to engage tabs 83 and 82, as illustrated. Bias of spring 31 retains tabs in engagement and provides frictional clamping of ball 11 (FIG. 1) of ball stud 10.

In its preferred embodiment, the magnetic door holder armature assembly is mounted to the door or movable structure, while the mating electromagnet is mounted to the wall or stationary structure. This arrangement, however, may be reversed if conditions so require.

Figure 2:
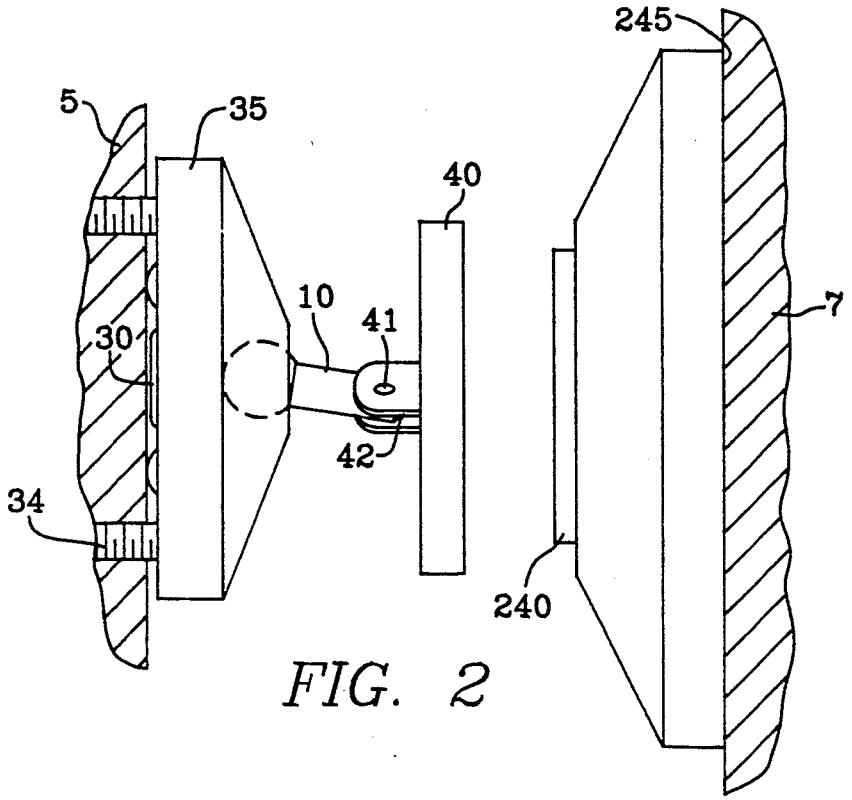
FIGS 2 and 2A show elevation and plan views, respectively, of the magnetic door holder armature of the present invention coupled with an electromagnet.
Figure 2A:
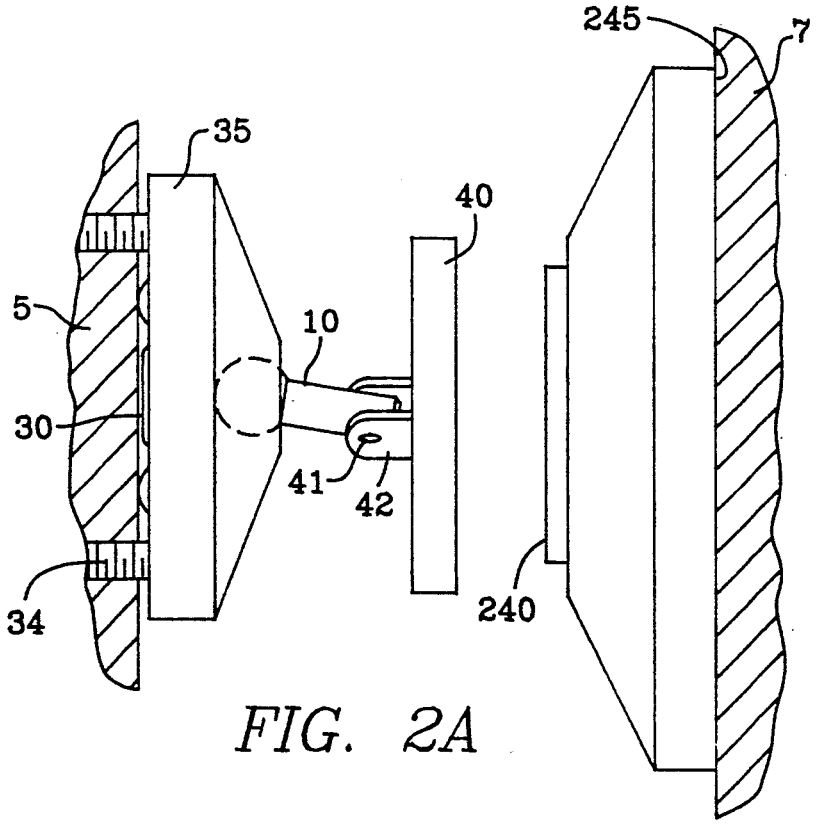

FIGS. 2 and 2A present elevation and plan views, respectively, of the armature assembly of the present invention in use with a misaligned electromagnet. These figures illustrate the accommodation of combined vertical and horizontal misalignment by the armature assembly of the present invention. These views illustrate compensation by the armature assembly for both Y axis and Z axis misalignment. This is made possible by the articulation provided by clevis 42 and pin 41, together with the universal flexibility and the rotatability of body 35 about ball stud 10.

Figure 3:
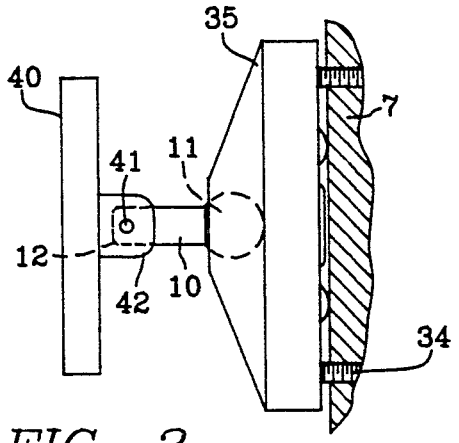
FIGS. 3, 4, and 5 show the electromagnetic armature assembly of the present invention in its preferred embodiment, and in two alternative embodiments, respectively.
Figure 4:
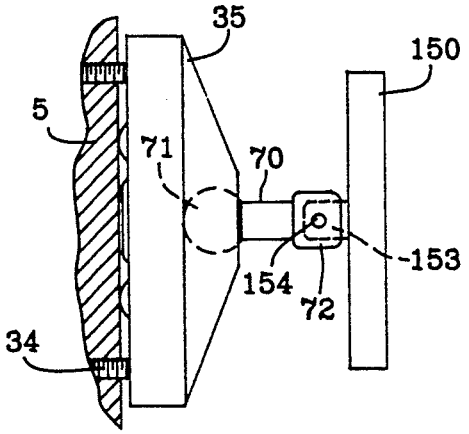
Figure 5:
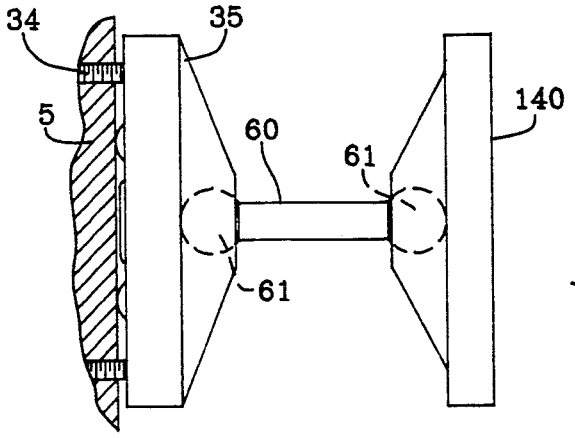

FIGS. 3 to 5 present two alternative embodiments of the armature assembly of the present invention. FIG. 3 shows the invention in its preferred embodiment with the exception that, in this case, armature mount body 35 is mounted to the wall or stationary structure 7. In all other respects, the embodiment of FIG. 3 is the same as that shown in FIGS. 1 and 2.

The armature assembly of FIG. 4 is very similar to the preferred embodiment, except that, in this case, armature plate 150 has a permanently attached protruding cross drilled stud 153 which couples by pin 154 to clevis 72. Clevis 72 is part of ball stud 70, the other end of which couples to mounting body 35. FIG. 5 presents another embodiment. Ball stud 60 is equipped with a ball 61 at each end. In this case, armature plate 140, as well as mounting body 35, is adapted to couple to ball 61 on ball stud 60.

Figure 6:
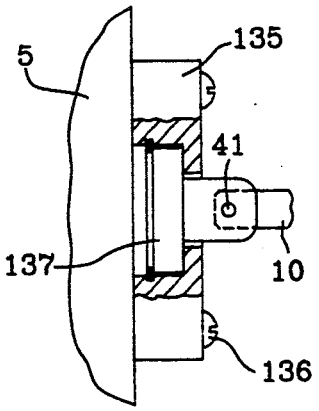
FIGS.6 and 7 show partially sectional views of alternative embodiments of the present invention having the ball end of the ball stud connected to the armature plate instead of the mounting body.
Figure 7:
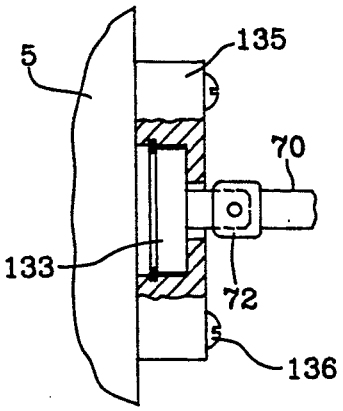

As seen in FIGS. 6 and 7, it is also possible to achieve the same universal adjustability with the clevis 137 or cross drilled stud 133 situated on the mounting body 135. In this embodiment, clevis 137 or stud 133 is rotatable about its axis at its attachment to mounting body 135. Here, also, mounting body 135 is attached directly to structural member 5 using fasteners 136 through body 135. Note that, in all Figures, there is universal flexibility of the ball stud with respect to the structurally mounted mounting bracket body. This is provided by the ball end of the ball stud in FIGS. 1-5 and by the clevis/cross drilled stud in combination with the axially rotatable member 137, 133 in FIGS. 6 and 7. This allows adjustment of the armature plate in a 360° arc about the axis of the mounting bracket body while permitting the armature plate to remain parallel to the body or to be tilted to maintain full contact with the electromagnet.

All of these embodiments provide the same universal adjustability required to accommodate combinations of misalignments. It is preferred that armature plates and electromagnets have circular shapes, so that there is no requirement for radial orientation, or "clock", between the armature and the electromagnet.

What is claimed is:

1. An armature assembly, for use with an electromagnetic door holder, comprising:

a mounting bracket body pivotable about at least two axes and connected with a first end of a ball stud means and mounted on a first structural member; and an armature plate means for coacting with an electromagnet mounted on a second structural member, said armature plate means being pivotably connected with a second end of said ball stud means.

2. The armature assembly of claim 1, wherein the ball stud means comprises a ball means at one of said first and second ends for pivotably connecting with a socket on said mounting bracket body and a clevis means at the other of said first and second ends for pivotably connecting with a drilled stud on said armature plate means.

3. The armature assembly of claim 1, wherein the ball stud means comprises a ball means at each of said first and second ends.

4. The armature assembly of claim 1, wherein the ball stud means comprises a ball means at one of said first and second ends and a transversely drilled stud means at the other of said first and second ends for pivotably connecting with a clevis means on said armature plate means.

5. The armature assembly of claim 1, wherein the first structural member is a movable door and the second structural member is a stationary wall of a passageway.

6. The armature assembly of claim 1, wherein both the first and second structural members are movable doors.

7. The armature assembly of claim 1, wherein the ball stud means comprises a ball means at one of said first and second ends and a transversely drilled stud means at the other of said first and second ends for pivotably connecting with a rotatable clevis means on said mounting body.

8. The armature assembly of claim 1, wherein the ball stud means comprises a ball means at one of said first and second ends and a clevis means at the other of said first and second ends for pivotably connecting with a rotatable transversely drilled stud means on said mounting body.

9. An armature assembly, for use with an electromagnetic door holder, comprising:

a substantially circular mounting bracket plate mounted on a first structural member and having a plurality of axially offset radially outwardly extending tabs about a circumferential edge;

a mounting body having a substantially circular cavity and a plurality of radially inwardly extending tab means for engaging with the tabs of said mounting bracket plate to clamp said mounting body to said mounting bracket plate; and an armature plate means for coacting with an electromagnet mounted on a second structural member, said armature plate means being pivotably and articulably connected to said mounting body by a ball stud means.

10. The armature assembly of claim 9, wherein said mounting bracket plate is first fastened to said first structural member, and the mounting body, incorporating the ball of said ball stud means and a biasing socket means, is placed over and forced axially toward said mounting bracket plate against said biasing socket means and rotated to engage the tab means of said mounting body with the tabs of said mounting bracket plate.

* * * * *